US006568651B2

(12) United States Patent
Reid

(10) Patent No.: US 6,568,651 B2
(45) Date of Patent: May 27, 2003

(54) CONCRETE FORM SYSTEM

(75) Inventor: John A. Reid, South Jordan, UT (US)

(73) Assignee: John Reid Investments, South Jordan, UT (US)

( * ) Notice: Subject to any disclaimer, the term of this patent is extended or adjusted under 35 U.S.C. 154(b) by 0 days.

(21) Appl. No.: 09/793,380

(22) Filed: Feb. 26, 2001

(65) Prior Publication Data

US 2002/0116894 A1 Aug. 29, 2002

(51) Int. Cl.[7] ..... E04G 11/06

(52) U.S. Cl. ..... 249/44; 249/219.1; 249/191; 249/45; 249/194; 403/294

(58) Field of Search ..... 249/48, 209, 159, 249/193, 194, 219.1, 34, 47, 44, 45, 191, 192, 216, 218; 52/294, 586.1, 588.1

(56) References Cited

U.S. PATENT DOCUMENTS

| | | | | | |
|---|---|---|---|---|---|
| 1,212,654 | A | * | 1/1917 | McKay | 249/189 |
| 1,754,638 | A | * | 4/1930 | Mead | 249/193 |
| 3,648,962 | A | * | 3/1972 | Farley | 249/189 |
| 3,712,576 | A | * | 1/1973 | Dagiel | 249/192 |
| 4,442,644 | A | * | 4/1984 | Jukes | 52/213 |
| 4,545,163 | A | * | 10/1985 | Asselin | 249/213 |
| 4,914,874 | A | * | 4/1990 | Graham, Jr. | 217/43 A |
| 5,240,224 | A | * | 8/1993 | Adams | 249/93 |
| 5,535,565 | A | * | 7/1996 | Majnaric et al. | 249/192 |
| 5,562,272 | A | * | 10/1996 | McAbee et al. | 249/192 |
| 5,616,271 | A | | 4/1997 | Podgurski | |
| 5,833,872 | A | * | 11/1998 | De Le fevre | 249/192 |
| 5,861,105 | A | * | 1/1999 | Martineau | 249/190 |
| 5,997,792 | A | * | 12/1999 | Gordon | 249/192 |
| 6,021,994 | A | * | 2/2000 | Shartzer, Jr. | 249/189 |
| 6,164,615 | A | | 12/2000 | Basham | |
| 6,175,462 | B1 | * | 1/2001 | Chung et al. | 360/66 |
| 6,250,033 | B1 | * | 6/2001 | Zelinsky | 52/275 |
| 6,322,047 | B1 | * | 11/2001 | Holmboe, Jr. | 249/19.2 |

FOREIGN PATENT DOCUMENTS

| | | | | |
|---|---|---|---|---|
| EP | 0062420 | * | 3/1982 | E04G/11/08 |
| JP | 6-307077 | * | 4/1993 | E04G/13/02 |

* cited by examiner

*Primary Examiner*—Carl D. Friedman
*Assistant Examiner*—Chi Q. Nguyen
(74) *Attorney, Agent, or Firm*—Thorpe North & Western

(57) ABSTRACT

A concrete form system for receiving concrete includes a plurality of interlocking form panels having opposite side ends, and which capable of being selectively arranged in series as a wall of a form configured to receive concrete. A plurality of attachments are each disposed between adjacent form panels, and vertically engage the side ends of adjacent form panels to interlock the side ends of the adjacent form panels to resist lateral separation of the adjacent form panels. The attachments an include one or more channels or engagement walls, and an insert received withing the channels or engaging the engagement walls. Ties or brackets can extend between parallel, spaced-apart form panels to maintain a predetermined, spaced-apart distance. A gauge bar can moveably extend into the form to indicate a fill level.

32 Claims, 4 Drawing Sheets

CONCRETE FORM SYSTEM

BACKGROUND OF THE INVENTION

1. Field of the Invention

The present invention relates generally to a concrete form system, particularly well suited for footings. More particularly, the present invention relates to a footing form system with a plurality of free-standing, interlocking panels with attachments that vertically engage the ends to resist lateral separation.

2. Related Art

Houses and other buildings require footings upon which the house or building rests. The footings are typically formed of concrete poured at locations corresponding to points where the house or building applies its weight. Thus, the footings can be formed about the perimeter of the house and/or at discrete areas. Foundation walls can rest on the perimeter footings, while columns or posts can rest on the footings formed at discrete areas. The footings are often reinforced with rebar.

A common method for forming the footings includes creating footing forms with boards or planks, such as various lengths of 2×10s, or 2×12s. The boards or planks are arranged to form the perimeter of the forms, and stakes are driven into the ground adjacent the boards or planks to maintain their location. Rebar can be arranged in the form, and concrete is poured in the form. After the concrete cures, the boards or planks are removed, usually by impacting the boards or planks with a hammer, and removing the stakes. Such boards or planks often become damaged and must be replaced. In addition, arranging, staking, and removing the boards or planks is often time consuming, and thus costly.

SUMMARY OF THE INVENTION

It has been recognized that it would be advantageous to develop a concrete form system for receiving concrete. In addition, it has been recognized that it would be advantageous to develop a footing form system for forming footings. In addition, it has been recognized that it would be advantageous to develop a concrete form system which does not require stakes, is durable, and is easier to arrange and remove.

The invention provides a concrete form system configured to receive concrete. The system includes a plurality of interlocking form panels which have opposite side ends. The form panels are capable of being selectively arranged in series as a wall of a form to receive concrete. In addition, the system includes a plurality of attachments, each one disposed between adjacent form panels. The attachments vertically engage the side ends of adjacent form panels to interlock the side ends of the adjacent form panels to resist lateral separation of the adjacent form panels.

In accordance with a more detailed aspect of the present invention, each of the plurality of attachments preferably extends along a majority of a length of the side ends of the adjacent form panels, and lock a majority of the length of the side ends of adjacent form panels together. More preferably each of the plurality of attachments extends along an entire length of the side ends of the adjacent form panels, and lock the entire length of the side ends of adjacent form panels together.

In accordance with another more detailed aspect of the present invention, each attachment includes at least one channel and an elongated insert. The channel is formed along a length of one of the side ends of the form panels. The insert is securable to an adjacent form panel and removably receivable within the at least one channel.

In accordance with another more detailed aspect of the present invention, each attachment includes at least two channels and an elongated insert. The channels are each formed along a length of one of the side ends of the adjacent form panels. The insert is removably receivable within both of the at least two channels.

In accordance with another more detailed aspect of the present invention, each attachment includes at least two opposing engagement walls and an elongated coupler. The engagement walls are each formed along a length of one of the side ends of the adjacent form panels, and are oriented transverse to an inner surface of the form panels. The coupler releasably engages the opposing engagement walls.

In accordance with another more detailed aspect of the present invention, the system includes at least two panels attached end-to-end in series in a co-linear orientation. Each of the at least two panels include an elongated opposing engagement wall extending along opposing ends, and oriented transverse to an inner surface of the form panels. A C-shaped coupler releasably receives the opposing engagement walls therein.

In accordance with another more detailed aspect of the present invention, the system includes at least two panels attached end-to-end in series in a perpendicular orientation. Again, each of the at least two panels include an elongated opposing engagement wall extending along opposing ends and oriented transverse to an inner surface of the form panels. A W-shaped coupler cooperates with the opposing engagement walls to releasably hold the panels together.

In accordance with another more detailed aspect of the present invention, the system includes a tie coupled to and extend between parallel, spaced-apart form panels, to maintain the form panels at a predetermined spaced-apart width.

In accordance with another more detailed aspect of the present invention, the tie has opposite ends, each attached to one of the plurality of attachments, to maintain the side ends of the form panels at a predetermined spaced-apart width.

In accordance with another more detailed aspect of the present invention, the system includes or tie includes a pair of brackets, each one configured to be coupled to one of parallel, spaced-apart form panels. Each of the brackets are adjustably coupled to the other one of the pair of brackets to adjustably maintain the form panels at a predetermined spaced-apart width.

In accordance with another more detailed aspect of the present invention, each of the brackets are attached to one of the plurality of attachments, to maintain the side ends of the form panels at a predetermined spaced-apart width.

In accordance with another more detailed aspect of the present invention, the system includes a gauge bar movably coupled to the tie or brackets, and extends downwardly between the parallel, spaced-apart form panels to indicate a fill level.

In accordance with another more detailed aspect of the present invention, the form panels are sized to form footings.

Additional features and advantages of the invention will be apparent from the detailed description which follows, taken in conjunction with the accompanying drawings, which together illustrate, by way of example, features of the invention.

DETAILED DESCRIPTION

Figure 1:
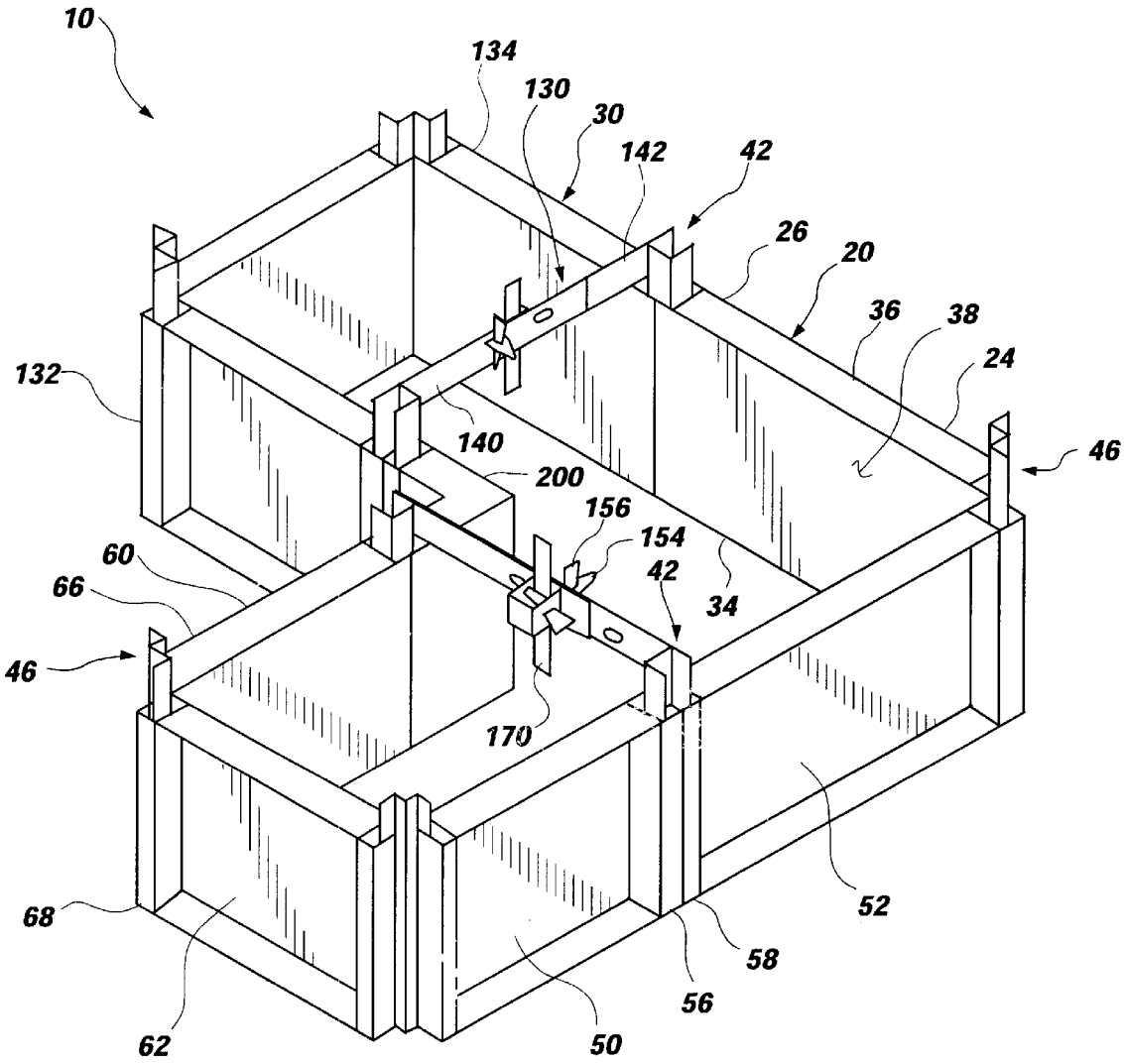
FIG. 1 is a perspective view of a concrete form system in accordance with the present invention shown in an exemplary configuration.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

As illustrated in FIG. 1, a concrete form system, indicated generally at 10, in accordance with the present invention is shown for receiving and forming concrete. The system 10 of the present invention is particularly well suited for forming footings, and thus the system 10 is described and illustrated as being configured as a footing form system for forming concrete footings. As stated above, structures such as houses and other buildings typically rest on, or are supported by, the footings. Thus, the footings typically are located at areas or points to support the weight of the structure. Therefore, footings are typically formed about a perimeter of the structure to receive foundation walls, and at other areas, such as to receive a column or pillar. Foundations are an example of a field which may benefit from the use of such a system 10 for forming concrete. It will be appreciated that the system 10 of the present invention also can be configured for use for forming other concrete, including for example, foundation walls.

Figure 2:
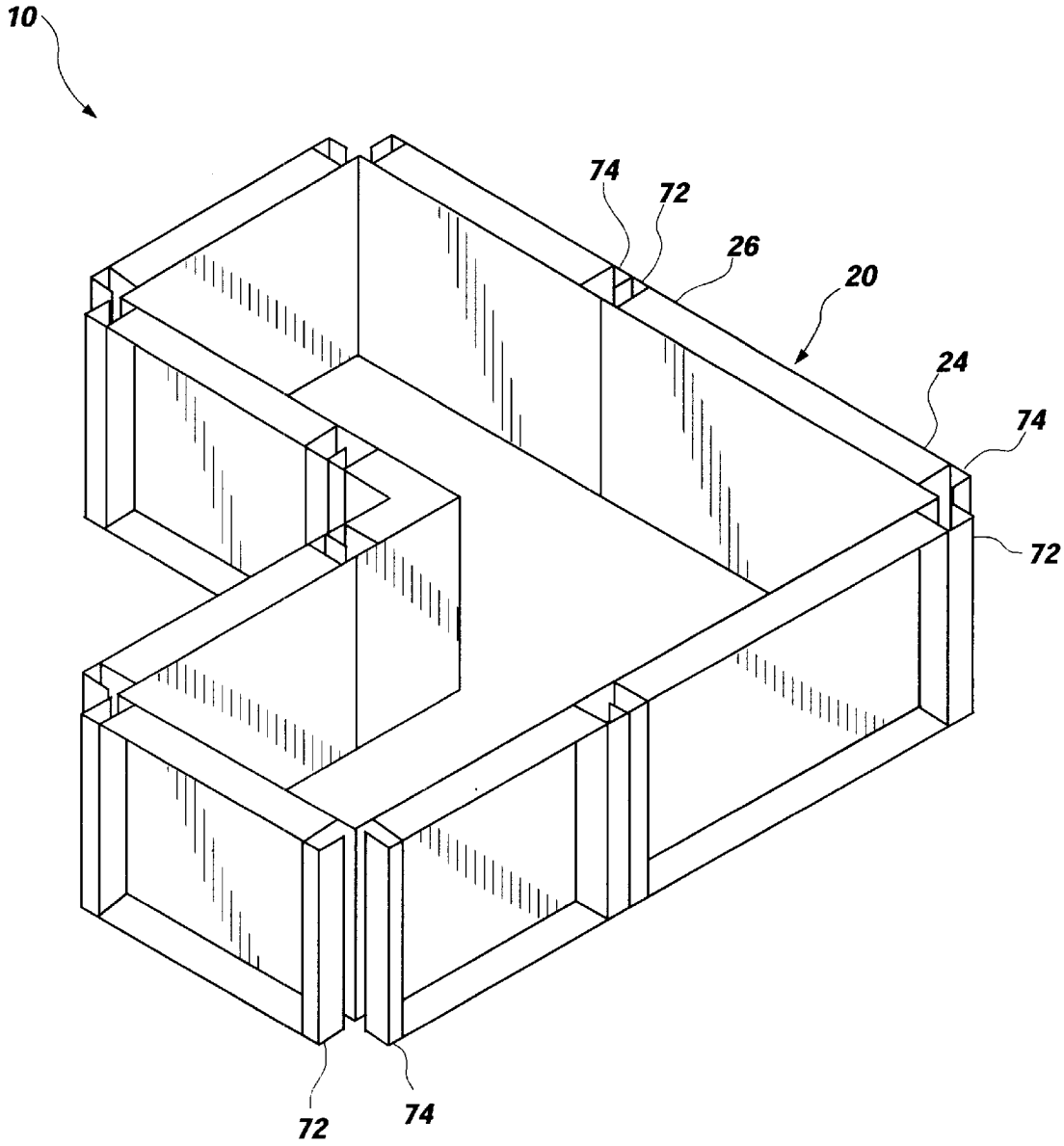
FIG. 2 is a perspective view of a portion of the concrete form system of FIG. 1 with various components removed for clarity.

FIGS. 1 and 2 show an exemplary configuration of the form system 10 of the present invention. It is, of course, understood that the system 10 of the present invention can be configured as desired to obtain the desired shape or layout of the footing, and that the configuration shown in FIGS. 1 and 2 is illustrative only. In addition, FIG. 2 shows the system 10 with various components of the system removed for clarity.

The concrete form system 10 of the present invention includes a plurality of form panels 20 arranged in such a way so as to create a wall for a form or enclosure which receives concrete. Thus, the form panels 20 can be arranged about a perimeter of the desired area or location to receive concrete. The form panels 20 have opposite side ends 24 and 26 which can be abutted to opposing side ends of adjacent form panels. Thus, the form panels can be selectively arranged in series, or end-to-end, to form an enclosure or area 30 to receive concrete.

The form panels 20 advantageously interlock with one another to create a free-standing enclosure, or to make the panels 20 freestanding. Thus, the system 10 of the present invention advantageously does not require stakes or other methods for securing the panels 20 or enclosure to the ground.

The panels 20 also have a bottom end or edge 34, which can be disposed on a support surface such as the ground, and a top or upper edge or surface 36. In addition, the panels 20 have an inner surface 38 which defines the enclosure 30 or area for receiving concrete. Preferably the inner surface 38 is smooth or otherwise configured to be releasable from the concrete after the concrete cures.

The concrete form system 10 of the present invention can be modular, and the form panels 20 can include a plurality of various different panels of various different sizes and shapes which can be arranged together to create the desired form or enclosure 30. For example, the form panels 20 may be provided in various different lengths, or sets of standard lengths. In addition, the form panels can be configured to form footings, as stated above. Thus, the form panels 20 may have a height appropriate for footings, for example preferably between 8 and 14 inches. The form panels 20 can be formed of metal, such as steel or aluminum. In addition, the form panels 20 can have a general C-shaped cross section to provide strength and rigidity to the form panel.

As stated above, the form panels 20 advantageously interlock and are free-standing. In addition, the side ends 24 and 26 of the panels preferably and advantageously interlock with the side ends of adjacent panels so that opposing side ends of adjacent panels are themselves interlocked together. The system 10 of the present invention advantageously includes a plurality of attachments, indicated generally at 42 and 46, formed between adjacent form panels 20. The attachments may include an attachment 42 for attaching adjacent form panels in a co-linear configuration, and attachments 46 configured to attach adjacent form panels in a perpendicular or corner configuration. The attachments 42 and 46 preferably and advantageously vertically engage the side ends 24 and 26 of adjacent form panels to interlock the side ends together and resist lateral separation of the adjacent form panels.

The attachments 42 and 46 preferably extend along a majority of a length or height of the side ends 24 and 26 to interlock a majority of the length or height of the side ends of the adjacent form panels. Most preferably the attachments 42 and 46 extend along the entire length or height of the side ends and interlock the entire length or height of the side ends of the adjacent form panels. Thus, a majority of the length or height, or the entire length or height, of the opposing side ends of adjacent form panels are interlocked to form a secure and free-standing enclosure.

For example, the attachment 42 may be formed between adjacent form panels 50 and 52, which are arranged in a co-linear configuration. The adjacent form panels 50 and 52 have opposing side ends 56 and 58, respectively. The attachment 42 interlocks the opposing side ends 56 and 58 of the adjacent form panels 50 and 52. As stated above, the attachment 42 preferably extends along the entire length or height of the side ends 56 and 58, and thus the panels 50 and 52, to interlock the entire length or height of the side ends 56 and 58.

Similarly, the attachment 46 is formed between adjacent form panels 60 and 62 which have opposing side ends 66 and 68, respectively. The adjacent form panels 60 and 62 are configured in a perpendicular configuration to form a corner. Again, the attachment 46 preferably extends along the entire length of the side ends 66 and 68.

Because the form panels 20 interlock together, the resulting enclosure can be free-standing, and thus require no further means for securing the enclosure to the ground, such as stakes. In addition, attaching the form panels 20 along the entire length or height of their side ends 24 and 26 advantageously makes the enclosure more secure, prevents concrete from seeping between adjacent form panels, and helps the enclosure to be free-standing.

Figure 3:
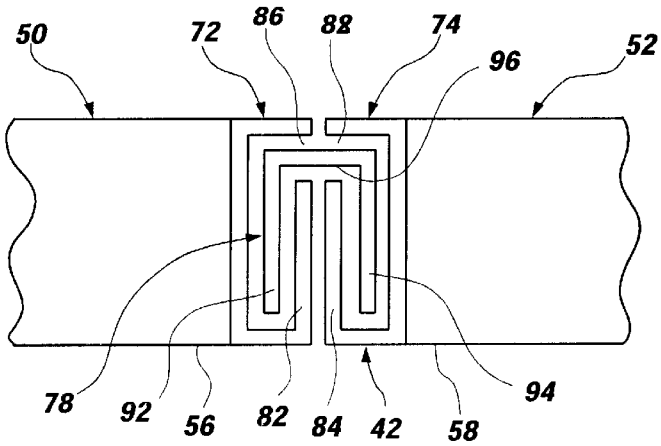
FIG. 3 is a top view of an attachment of the concrete form system of FIG. 1 in accordance with the present invention.
Figure 4:
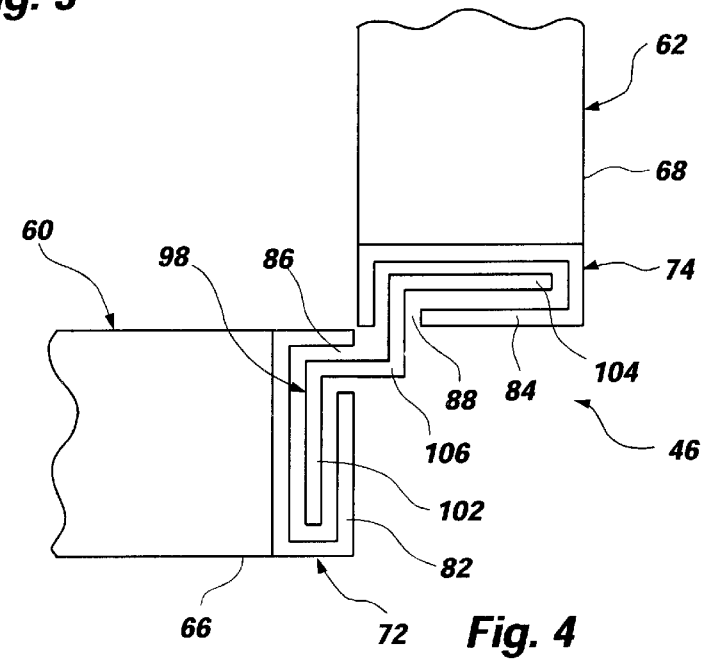
FIG. 4 is a top view of another attachment of the concrete form system of FIG. 1 in accordance with the present invention.

The attachments 42 and 46 are shown in greater detail in FIGS. 3 and 4, respectively. Referring to FIG. 3, the attachment 42 includes channels 72 and 74 formed along a length or height of the side ends 56 and 58, respectively, of the adjacent form panels 50 and 52. In addition, an elongated insert 78 is removably received within the channels 72 and 74 to interlock the form panels 50 and 52. The channels 72 and 74 may include opposing engagement walls 82 and 84, respectively, which extend along the side ends 56 and 58, and which are oriented transverse to the inner surface of the form panels 50 and 52. Thus, the opposing engagement walls 82 and 84 may form the most distal portions of the side panels 50 and 52. In addition, the channels 72 and 74 can include openings 86 and 88, respectively, which face outwardly from the side ends 56 and 58, which allow the insert 78 to extend between the channels 72 and 74. Thus, the channels 72 and 74 can be described as having a generally G-shaped cross section, or an enclosed rectangular shaped cross section with openings 86 and 88.

The insert 78 may include insert portions 92 and 94 which are received within the channels 72 and 74, respectively, and an interconnecting portion 96 formed between the insert portions 92 and 94 and extending between the channels 72 and 74 to interlock or interconnect the form panels 50 and 52. Thus, the insert 78 can have a generally C-shaped or U-shaped cross section.

The attachment 42 shown in FIG. 3 is configured for interlocking adjacent form panels 50 and 52 in a co-linear configuration. The attachment 46 shown in FIG. 4 is configured for attaching adjacent form panels 60 and 62 in a perpendicular configuration. As shown in FIG. 4, form panels 60 and 62 are similar in most respects to the form panels 50 and 52 described above, and include channels 72 and 74 formed along the length of the side ends 60 and 68, respectively. Again, the channels 72 and 74 include engagement walls 82 and 84, and also openings 86 and 88. The attachment 46 includes an insert 98 which is removably received within both of the channels 72 and 74 to interlock the adjacent form panels 60 and 62 in a perpendicular orientation. The insert 98 includes insert portions 102 and 104, which are removably received within the channels 72 and 74, respectively. In addition, the insert 98 includes an interconnecting section 106 formed between the insert sections 102 and 104, and extending between the channels 72 and 74 to interconnect the form panels 60 and 62. The insert 98 may have a generally W-shaped or M-shaped cross section, or the interconnecting section 106 may be formed at a right angle as opposed to linearly in order to form the perpendicular attachment.

In order to attach adjacent form panels 50 and 52 in a co-linear relationship, as shown in FIG. 3, the form panels 50 and 52 are arranged adjacent one another, and with the opposing ends 56 and 58, or channels 72 and 74, abutting to one another, and inserting the insert 78 into the channels 72 and 74. Similarly, the adjacent form panels 60 and 62 are interlocked in a perpendicular orientation, as shown in FIG. 4, by arranging the form panels 60 and 62 adjacent one another and perpendicular with the inside edges of the opposing ends 66 and 68, or channels 72 and 74, generally abutting to one another, and inserting the insert 98 into the channels 72 and 74.

Figure 5:
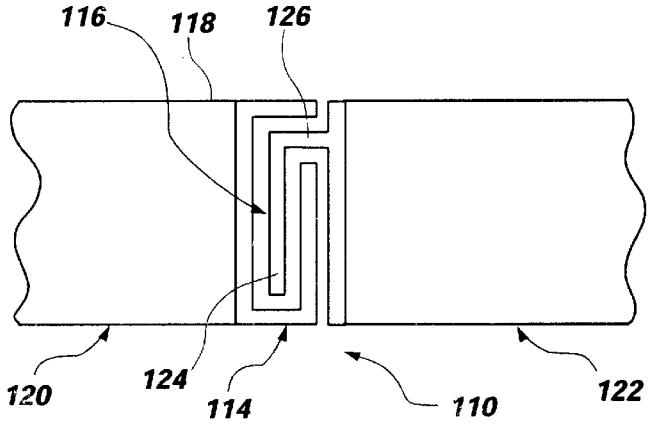
FIG. 5 is a top view of another attachment of the concrete form system in accordance with the present invention.

While the attachments 42 and 46 have been described above with respect to a pair of channels 72 and 74 formed in the opposing ends of the adjacent form panels, it will be appreciated that different configurations of the attachments are possible. For example, referring to FIG. 5, an attachment 110 can include at least one channel 114 and at least one insert 116. The at least one channel 114 can be formed along the length or height of the side end 118 of one of the form panels 120, while the insert 116 is secured to the other form panel 122. The channel 116 can be similar to the channel 72 and 74 described above. The insert 116 can include an insert portion 124, removably received within the channel 114 and an interconnecting section 126, coupled to and between the insert section 124 and the other panel 122 to extend from the form panel 122 and into the channel 114. Thus, the form panels 120 and 122 can be interlocked together by aligning the insert 116 of the form panel 122 with the channel 114 of the form panel 120, and vertically sliding the form panels 120 and 122 with respect to one another, and thus sliding the insert 116 into the channel 114. The attachment 110 has been described as attaching form panels in a co-linear orientation, it is of course understood that a similar attachment can be formed to attach the form panels in a perpendicular configuration.

The inserts described above form couplers which can releasably engage the opposing engagement walls of the channels or side ends of the form panels to interlock the adjacent form panels.

Referring again to FIG. 1, the concrete form system 10 preferably includes one or more ties 130 coupled to and extending between parallel, spaced-apart form panels 132 and 134. The tie 130 maintains the form panels 132 and 134 at a predetermined, spaced-apart width. The tie 130 prevents the form panels 132 and 134 from expanding or displacing away from one another as concrete is poured into the enclosure 30. The tie 130 preferably is removably coupled to the form panels 132 and 134. In addition, the tie 130 preferably is adjustable, or expandable and retractable, such that the predetermined, spaced-apart width may be adjusted.

In addition the tie 130 preferably and advantageously is coupled to and between the attachments 42 of the parallel, spaced-apart form panels 132 and 134. Thus, the tie 130 maintains the side ends of the form panels 132 and 134 at the predetermined, spaced-apart width. The tie 130 can have opposite ends, each of which are attached to one of the attachments 42. Thus, the tie 130 and attachments 42 can be simultaneously coupled to the form panels 132 and 134, and simultaneously removed therefrom.

The tie 130 can include a pair of brackets 140 and 142, each attached to one of the parallel, spaced-apart form panels 132 and 134. The pair of brackets 140 and 142 are adjustably coupled together, and thus can be expanded or retracted to adjust the width between the form panels 132 and 134.

The pair of brackets 140 and 142 preferably and advantageously are attached to opposite attachments 42. Thus, the pair of brackets 140 and 142, each attached to an attachment 42, form a pair of attachment ties 146 and 148, which work together to both interlock adjacent form panels, and maintain spaced-apart form panels at a predetermined width. Thus, adjacent form panels can be interlocked with the tie attachment 146. Similarly, adjacent form panels spaced-apart therefrom can be interlocked with the tie attachment 148. The spaced-apart form panels can then be tied together by securing the tie attachments 146 and 148 together.

The brackets 140 and 142, or the tie attachments 146 and 148, can include a plurality of holes or apertures 152 which may be aligned to receive a pin 154 or the like to secure the brackets 140 and 142, or tie attachments 146 and 148, together. The pin 154 itself may have an aperture which extends past the holes 152 and brackets 140 and 142 to receive a retaining pin 156 therethrough, and thus maintain the pin 154.

Combining the ties 130 and attachments 42 advantageously reduces the number of parts required for the system 10. In addition, combining the brackets 140 and 142 with the attachments 42 to form the tie attachments 146 and 148 advantageously allows the ties 130 to be arranged or formed simultaneously as the attachments 42 are made.

Figure 6:
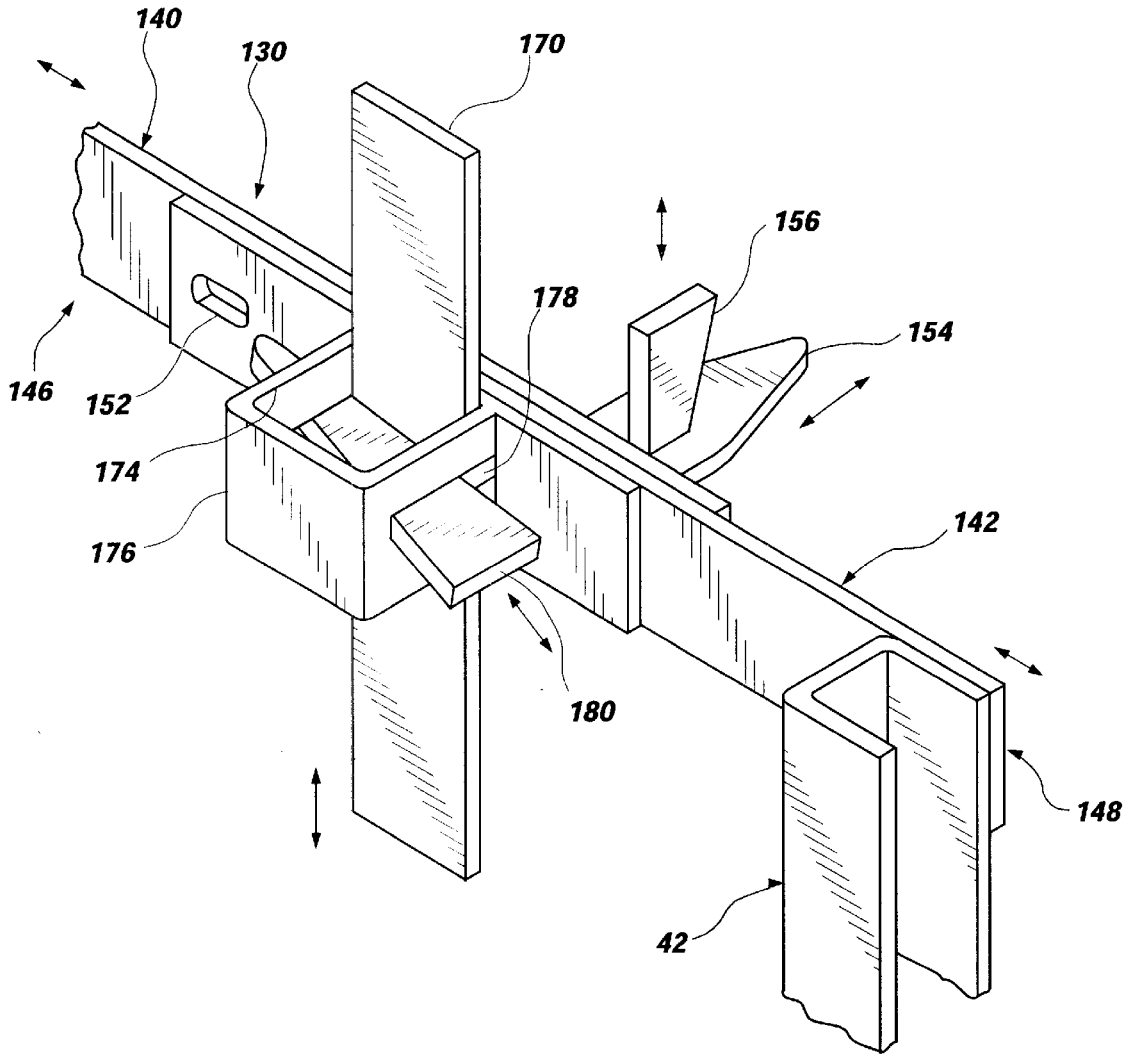
FIG. 6 is a partial perspective view of the concrete form system of FIG. 1.

Referring to FIGS. 1 and 6, the system 10 can include a gauge bar 170, which extends downwardly into the enclosure 30 formed by the form panels 20 to indicate a fill level. Thus, the gauge bar 170 may be adjusted as desired, and concrete poured within the enclosed until the concrete reaches the bottom of the gauge bar 170. The gauge bar 170 advantageously may be adjustably secured to the tie 130. A vertically oriented opening 174, may be formed on the tie 130, one of the brackets 140 or 142, or one of the tie attachments 146 or 148, to moveably receive the gauge bar 170 therein. The opening 174 may be formed by a housing 176 extending thereabout. Holes or openings 178 may be formed in the housing 176 to receive an angled pin 180 therethrough. Thus, the angled pin 180 may be inserted through the openings 178 and engage the gauge bar 170 to force the gauge bar 170 against a portion of the housing 176 to maintain the gauge bar at a desired elevation.

The gauge 170 and housing 176 advantageously can be coupled to the pin 154 which secures the brackets 140 and 142. Thus, the housing 176 and gage bar 170 are positioned over the enclosure as the pin 154 secures the brackets 140 and 142.

Referring again to FIG. 1, the concrete panel system 10 also can include a corner panel 200 formed at a right angle to facilitate the formation of an inner corner of the form or enclosure.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A concrete form system configured to receive concrete, the system comprising:

a) a plurality of form panels having opposite side ends selectively arrangable in series with opposing side ends of adjacent form panels being attached together to form a wall of an enclosure configured to receive concrete;

b) at least one channel, formed along at least one of the side ends of the form panels;

c) the at least one channel including an engagement wall, formed along the side end of the form panel, and oriented transverse to an inner surface of the form panel; and d) an elongated insert, securable to an adjacent form panel and removably receivable within the at least one channel to releasably engage the engagement wall to attach the side ends of the adjacent form panels.

2. A system in accordance with claim 1, wherein the at least one channel and the insert are vertically oriented.

3. A system in accordance with claim 1, wherein the at least one channel and the insert extend along a majority of a length of the side ends of the adjacent form panels, and lock a majority of the length of the side ends of adjacent form panels together.

4. A system in accordance with claim 1, further comprising:

a) at least two channels, each one formed along a length of one of the side ends of the adjacent form panels; and b) wherein the insert is removably receivable within both of the at least two channels.

5. A system in accordance with claim 1, wherein the plurality of form panels includes at least two panels attached end-to-end in series in a co-linear orientation;

wherein the at least two panels each include a channel formed along opposing side ends of the form panels, the channels including elongated opposing engagement walls oriented transverse to a length of the form panels; and wherein the insert includes a C-shaped coupler, releasably receiving the opposing engagement walls therein.

6. A system in accordance with claim 1, wherein the plurality of form panels includes at least two panels attached end-to-end in series in a perpendicular orientation;

wherein the at least two panels each include a channel formed along opposing side ends of the form panels, the channels including elongated opposing engagment walls oriented transverse to an inner surface of the form panels; and wherein the insert includes a W-shaped coupler, cooperating with the opposing engagement walls to removably hold the panels together.

7. A system in accordance with claim 1, further comprising:

a tie, configured to be coupled to and extend between parallel, spaced-apart form panels, to maintain the form panels at a predetermined spaced-apart width.

8. A system in accordance with claim 7, wherein the tie has opposite ends each attachable to one of the plurality of inserts, to maintain side ends of the form panels at a predetermined spaced-apart width.

9. A system in accordance with claim 1, further comprising:

a pair of brackets, each one configured to be coupled to one of parallel, spaced-apart form panels, and adjustably coupled to the other one of the pair of brackets, to adjustably maintain the form panels at a predetermined spaced-apart width.

10. A system in accordance with claim 9, wherein each of the brackets are attached to one of the plurality of inserts, to maintain the side ends of the form panels at a predetermined spaced-apart width.

11. A system in accordance with claim 1, further comprising:

a tie, coupled to and extend between tops of parallel, spaced-apart form panels to maintain the form panels at a predetermined spaced-apart width; and a gauge bar, movably coupled to the tie, to extend downwardly between the parallel, spaced-apart form panels, the gauge bar having a bottom to indicate a fill level between the parallel, spaced-apart form panels.

12. A system in accordance with claim 1, wherein the form panels are sized to form footings.

13. A concrete form system configured to receive concrete, the system comprising:

a) a plurality of form panels having opposite side ends selectively arrangable in series with opposing side ends of adjacent form panels being attached together to form a wall of an enclosure configured to receive concrete;

b) a plurality of channels, each one formed along a length of one of the side ends of the form panels;

c) the channels including engagement walls, formed along the side ends of the form panels, and oriented transverse to inner surfaces of the form panels;

d) a plurality of inserts, each one removably receivable within two channels of adjacent form panels, to releasably engage the engagement walls to interlock the side ends of the adjacent form panels; and e) at least one tie, configured to be coupled to and extend between parallel, spaced-apart form panels, having opposite ends each attachable to one of the inserts to maintain side ends of the form panels at a predetermined, spaced-apart width.

14. A system in accordance with claim 13, wherein the channels and inserts are vertically oriented.

15. A system in accordance with claim 13, wherein the channels and inserts extend along a majority of a length of the side ends of the adjacent form panels, and lock a majority of the length of the side ends of adjacent form panels together.

16. A system in accordance with claim 13, wherein the plurality of form panels includes at least two panels attached end-to-end in series in a co-linear orientation;

wherein the channels include elongated opposing engagement walls oriented transverse to an inner surface of the form panels; and wherein the insert includes a C-shaped coupler, releasably receiving the opposing engagement walls therein.

17. A system in accordance with claim 13, wherein the plurality of form panels includes at least two panels attached end-to-end in series in a perpendicular orientation;

wherein the channels include elongated opposing engagement walls oriented transverse to an inner surface of the form panels; and wherein the insert includes a W-shaped coupler, cooperating with the opposing engagement walls to removably hold the form panels.

18. A system in accordance with claim 13, wherein the at least one tie further comprises:

a pair of brackets, each one configured to be coupled to one of the parallel, spaced-apart form panels, and adjustably coupled to the other one of the pair of brackets, to adjustably maintain the form panels at a predetermined spaced-apart width.

19. A system in accordance with claim 13, further comprising:

a gauge bar, movably coupled to the tie, to extend downwardly between the parallel, spaced-apart form panels, the gauge bar having a bottom to indicate a fill level between the parallel, spaced-apart form panels.

20. A system in accordance with claim 13, wherein the form panels are sized to form footings.

21. A concrete form system configured to receive concrete, the system comprising:

a) a plurality of form panels having opposite side ends configured to be selectively arranged in series with opposing side ends of adjacent form panels being attached together to form a wall of an enclosure to receive concrete;

b) at least one channel, attached to at least one of the side ends of the form panels; and c) the at least one channel including an engagement wall, formed along the side end of the form panel, and oriented transverse to an inner surface of the form panel;

d) an elongated insert, separate from the at least one channel, securable to an adjacent form panel and removably received within the at least one channel to releasably engage the engagement wall to attach the side ends of the adjacent form panels.

22. A system in accordance with claim 21, wherein the at least one channel and the insert extend along a majority of a length of the side ends of the adjacent form panels, and lock a majority of the length of the side ends of adjacent form panels together.

23. A system in accordance with claim 21, wherein the at least one channel and the insert extend along an entire length of the side ends of the adjacent form panels, and lock the entire length of the side ends of adjacent form panels together.

24. A system in accordance with claim 21, wherein:

a) the at least one channel includes at least two channels, each one formed along a length of one of the side ends of the adjacent form panels; and b) the elongated insert is removably receivable within both of the at least two channels.

25. A system in accordance with claim 21, wherein the plurality of form panels includes at least two panels attached end-to-end in series in a co-linear orientation;

wherein each of the at least two panels include an elongated opposing engagement wall extending along opposing ends and oriented transverse to a length of the form panels; and further comprising a C-shaped coupler, configured to releasably receive the opposing engagement walls therein.

26. A system in accordance with claim 21, wherein the plurality of form panels includes at least two panels attached end-to-end in series in a perpendicular orientation;

wherein each the at least two panels include an elongated opposing engagement wall extending along opposing ends and oriented transverse to a length of the form panels; and further comprising a W-shaped coupler, configured to cooperate with the opposing engagement walls to releasably hold the panels together.

27. A system in accordance with claim 21, further comprising:

a tie, configured to be coupled to and extend between parallel, spaced-apart form panels, to maintain the form panels at a predetermined spaced-apart width.

28. A system in accordance with claim 27, wherein the tie has opposite ends configured so that each can be attachable to one of a plurality of inserts, to maintain the side ends of the form panels at a predetermined spaced-apart width.

29. A system in accordance with claim 21, further comprising:

a pair of brackets, each one configured to be coupled to one of parallel, spaced-apart form panels, and adjustably coupled to the other one of the pair of brackets, to adjustably maintain the form panels at a predetermined spaced-apart width.

30. A system in accordance with claim 29, wherein each of the brackets are configured to be attached to one of the plurality of attachments, to maintain the side ends of the form panels at a predetermined spaced-apart width.

31. A system in accordance with claim 21, further comprising:

a tie, configured to be coupled to and extend between tops of parallel, spaced-apart form panels, to maintain the form panels at a predetermined spaced-apart width; and a gauge bar, configured to be movably couplable to the tie, and configured to extend downwardly between the parallel, spaced-apart form panels to indicate a fill level.

32. A system in accordance with claim 21, wherein the form panels are sized to form footings.

* * * * *